United States Patent [19]

Downs et al.

[11] 3,987,761

[45] Oct. 26, 1976

[54] AUXILIARY HEATER FOR A GAS-FIRED WATER HEATER

[76] Inventors: Gordon L. Downs, 2607 Emerald St.; Woodrow W. Mecham, 632 Delfino Lane, both of Bakersfield, Calif. 93304

[22] Filed: Mar. 12, 1975

[21] Appl. No.: 557,772

Related U.S. Application Data

[63] Continuation-in-part of Ser. No. 514,568, Oct. 15, 1974, abandoned.

[52] U.S. Cl. ..... 122/20 B; 122/367 C

[51] Int. Cl.[2] ..... F22B 33/10

[58] Field of Search ..... 122/20 B, 367 A, 367 C, 122/13 R, 17, 18; 126/350 R, 361, 362

[56] References Cited

UNITED STATES PATENTS

| | | | |
|---|---|---|---|
| 43,749 | 8/1864 | Martin | 122/367 A |
| 548,941 | 10/1895 | Wilder | 122/250 R |
| 641,911 | 1/1900 | Wilkins et al. | 122/367 A |
| 975,894 | 11/1910 | Rudd | 122/250 R |
| 1,107,534 | 8/1914 | Lovekin | 122/20 B |
| 1,862,630 | 6/1932 | Morrow | 122/18 |
| 2,041,630 | 5/1936 | Wright | 122/13 R |
| 2,814,278 | 11/1957 | Cameron | 122/17 |
| 2,852,462 | 9/1958 | Andrus | 122/13 R |
| 3,170,511 | 2/1965 | Guthrie | 122/17 |
| 3,793,992 | 2/1974 | Marquez | 122/20 B |

*Primary Examiner*—Kenneth W. Sprague
*Assistant Examiner*—Larry I. Schwartz
*Attorney, Agent, or Firm*—Jack C. Munro

[57] ABSTRACT

An auxiliary water heating tank to be employed in combination with a conventional tank water heater which is gas fired and supplies heated flue gases to the ambient, the heated flue gases from the water heater to be supplied either into a flue pipe centrally located within the auxiliary heater tank or into a chamber surrounding the auxiliary heater tank, the first embodiment employing a plurality of heat conducting members extending transversely through said flue pipe with the ends of such extending within the auxiliary heater tank, the heating conducting members arranged in a spiral pattern throughout said flue pipe, the members adapted to conduct heat energy from said flue pipe into water contained within said auxiliary heater tank, the second embodiment employing heat sinks and the principle of thermosyphon to efficiently heat the water, the third embodiment conducting the exhaust gases of the water heater into a chamber totally encompassing the auxiliary heater tank.

8 Claims, 10 Drawing Figures

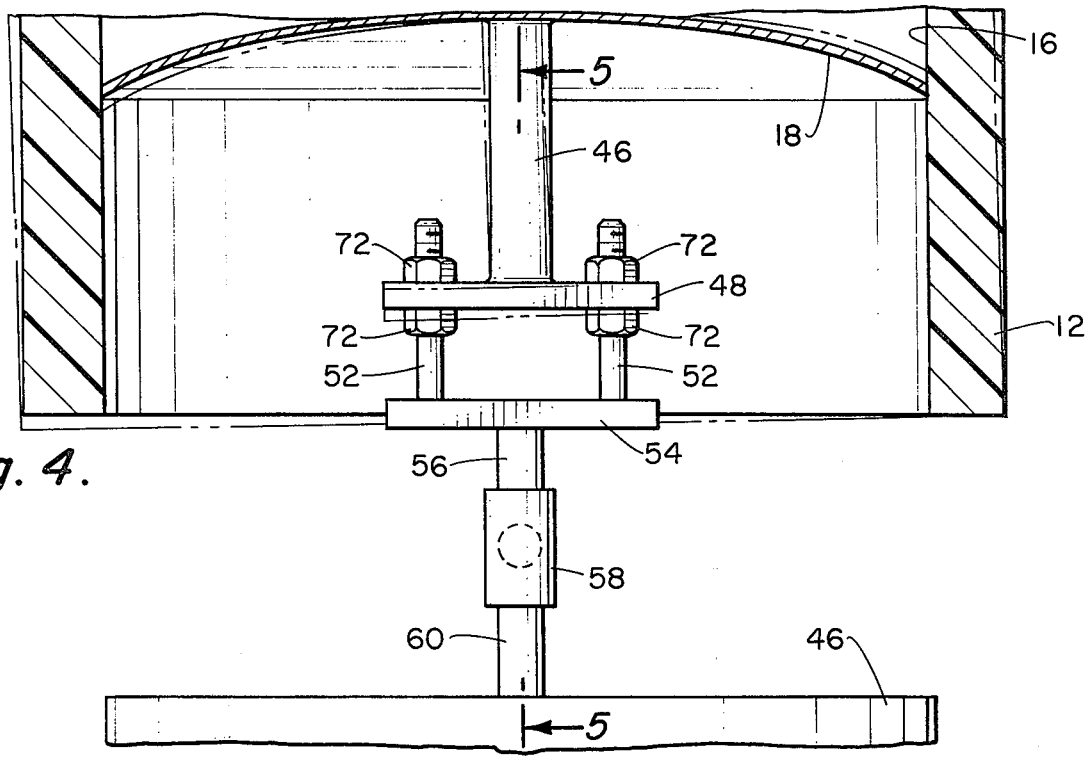
Fig. 4.
Fig. 5.
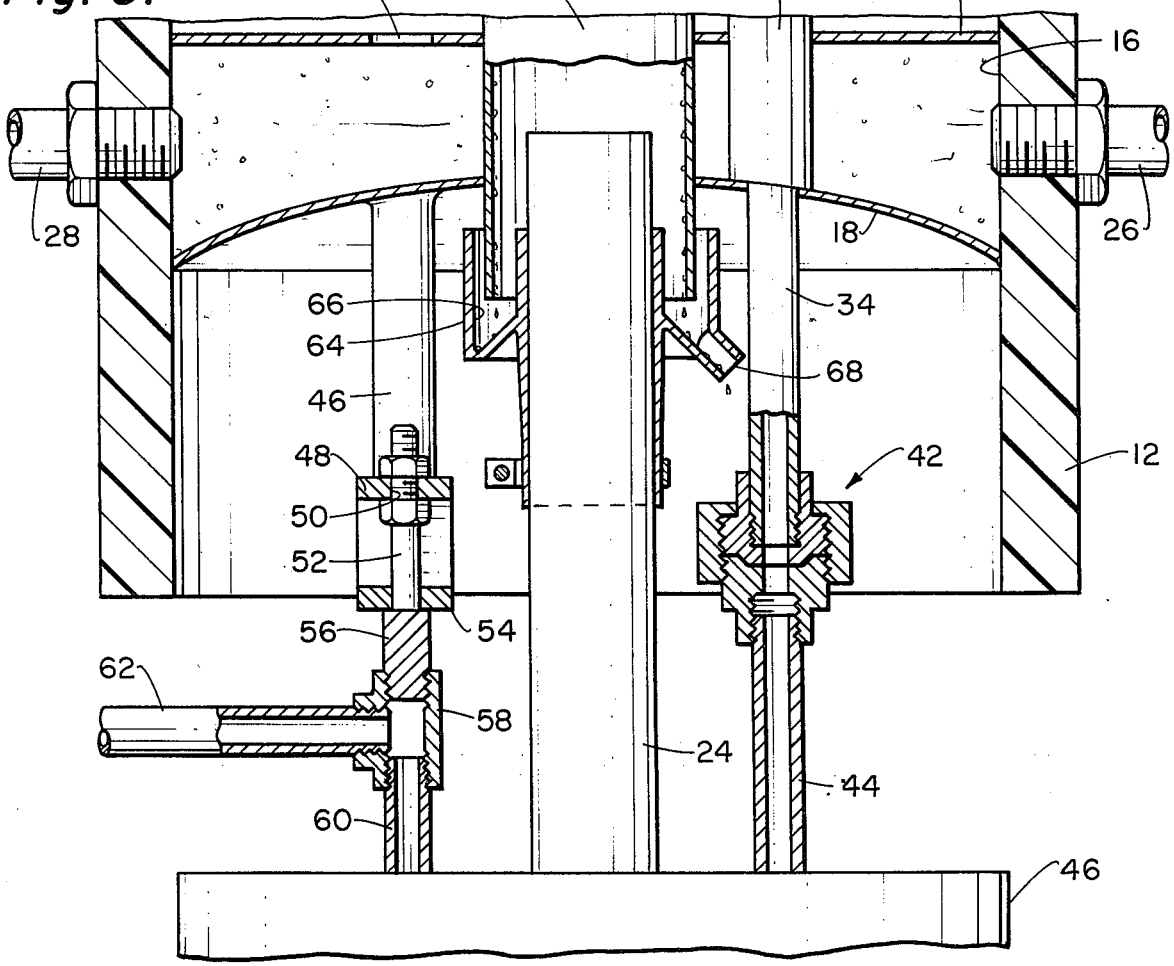

AUXILIARY HEATER FOR A GAS-FIRED WATER HEATER

REFERENCE TO PRIOR APPLICATION

This application is a continuation-in-part of patent application Ser. No. 514,568, filed Oct. 15, 1974, and now abandoned, entitled AUXILIARY HEATER FOR A GAS-FIRED WATER HEATER, by the present inventor.

BACKGROUND OF THE INVENTION

Places of residence employ water heaters. A large percentage of these water heaters use gas in preference to electricity as a source of heat. These gas-fired water heaters include an exhaust gas flue extending from the top of the heater tank and these gases are adapted to be conducted into the ambient. In actual practice, it has been found that the gases leaving a conventional water heater are at a quite high temperature, normally within the range of 450° to 700°F when the water heater main burner is operating. Normally, the energy contained within this heated gas is lost.

There is a need for an auxiliary type of water heater which can be attached to the main water heater which is to function to pre-heat the water which enters the main water heater, such pre-heating of the water being accomplished by the heated flue gases which are emitted from the water heater tank. Previously, it has been known to employ such an auxiliary type of water heater tank. However, in the past, these auxiliary type of water heater tanks have been of complex construction thereby substantially increasing manufacturing cost. Additionally, such water auxiliary water heater tanks of the prior art have not been designed to extract the maximum amount of heat energy from the flue gases.

SUMMARY OF THE INVENTION

The auxiliary water heater of this invention is to be located directly upon a conventional water heater tank. The flue of the conventional water heater tank is to extend within a flue pipe of the auxiliary tank. The auxiliary tank is mounted by a three point mounting arrangement upon the water heater tank so as to permit angular adjustment of the auxiliary tank with respect to the water heater tank. Within the first embodiment extending transversely across the flue pipe of the auxiliary tank are a plurality of heat conducting members, usually in the form of cylindrical metal rods. The ends of these heat conducting members extend within the water tank of the auxiliary tank. The heat conducting members are angularly disposed with respect to each other so as to form a spiral pattern along the longitudinal length of the flue pipe. This spiral pattern increases turbulence of the gas as it passes through the flue pipe thereby increasing energy transmission into the heat conducting members and hence into the auxiliary water tank. A condensate collector is mounted at the bottom of the flue pipe and is adapted to collect and transmit through a discharge means any condensate which will collect on the interior of the flue pipe.

The second embodiment conducts the exhaust gases through an enlarged passage containing a plurality of metallic heat conducting baffles (or heat sinks). The baffles also function to increase turbulence in the flue gases and to increase the heat transfer area so that a high rate of heat absorption may be obtained. A water conducting passage is centrally located within the enlarged passage which has an inlet located adjacent the bottom of the auxiliary tank and an outlet located adjacent the top of the auxiliary tank. Water is moved through the passage from the inlet to the outlet by a heat generated syphoning technique (thermosyphon) which increases efficiency.

The third embodiment is adequately summarily described in THE ABSTRACT OF THE DISCLOSURE and reference is to be had thereto.

The primary objective of the structure of this invention is to decrease the amount of fuel gas needed to heat a given amount of water and in actual practice is has been found that the structure of this invention will result in approximately twenty-four percent less fuel gas required.

A further objective of the structure of this invention is to employ an auxiliary heater tank which can be readily mounted upon an existing water heater tank.

A further objective of the structure of this invention is to employ an auxiliary water heater tank which is simple in construction and which can be manufactured at relatively low manufacturing cost.

BRIEF DESCRIPTION OF THE DRAWINGS

FIG. 4 is a cross-sectional view taken along line 4—4 of FIG. 1;

FIG. 5 is a cross-sectional view taken along 5—5 of FIG. 4;

BRIEF DESCRIPTION OF THE SHOWN EMBODIMENT

Figure 1:
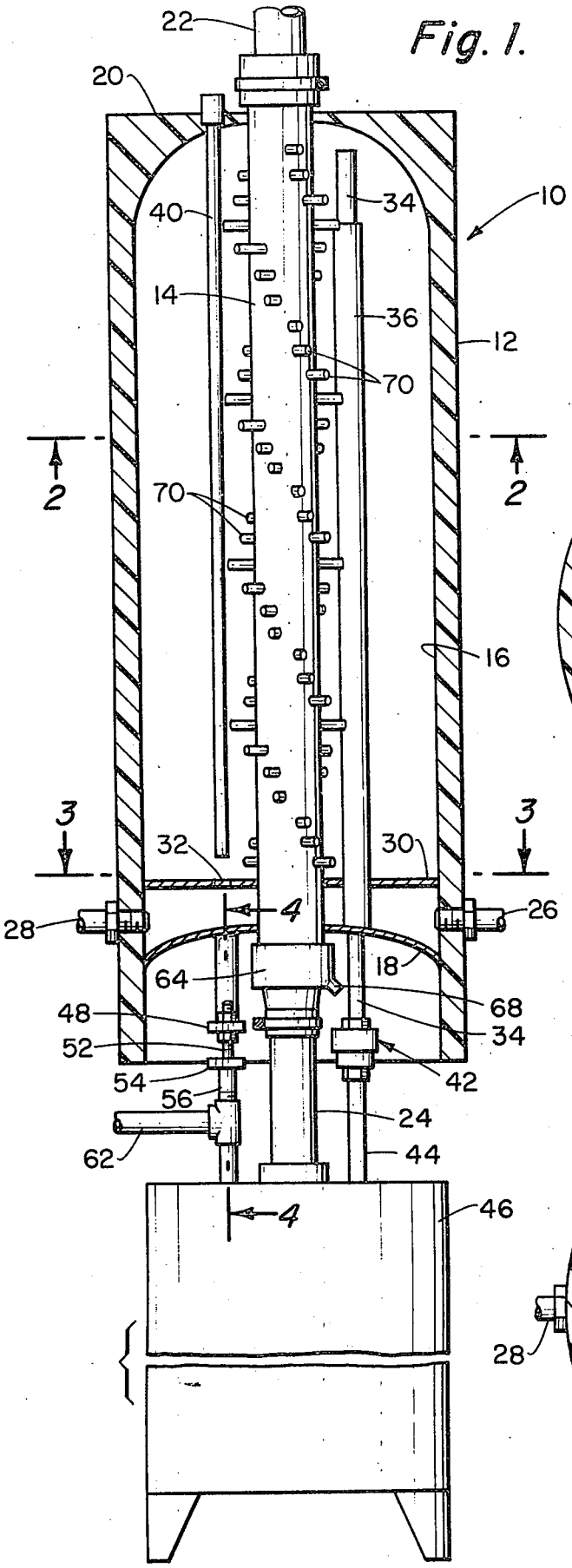
FIG. 1 is a partly in cross-section view showing the first embodiment of auxiliary heater tank of this invention mounted upon a conventional water heater tank.
Figure 2:
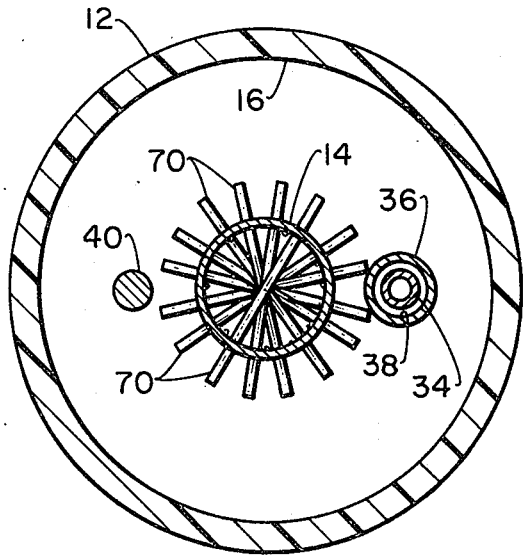
FIG. 2 is a cross-sectional view taken along line 2—2 of FIG. 1.
Figure 3:
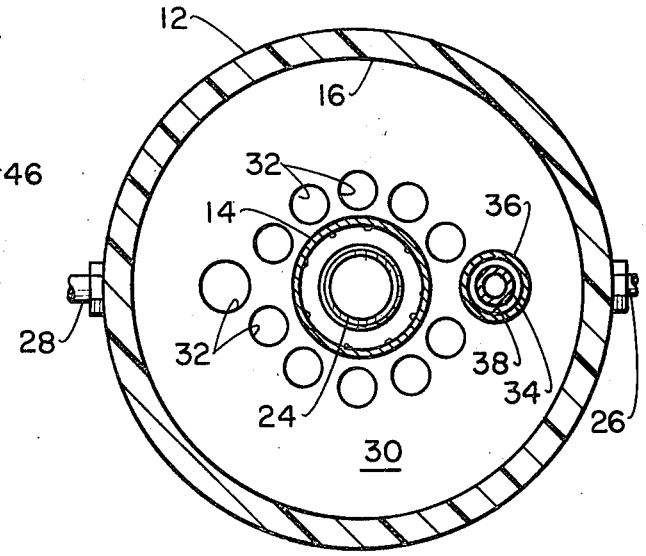
FIG. 3 is a cross-sectional view taken along line 3—3 of FIG. 1.

Referring particularly to the drawings, there is shown in FIG. 1 the auxiliary heater 10 of this invention which is generally composed of a tank 12 and a flue pipe 14. The tank 12 is generally in a cylindrical shape and includes an interior water containing chamber 16. The flue pipe 14 is conducted longitudinally through the center of the tank 12 and it establishes a water-tight connection with the bottom wall 18 of the tank 12 and also the top wall 20 of the tank 12. The upper end of the flue pipe 14 connects with an outlet flue pipe 22 which is normally conducted through the wall of a structure, such as a house or building and is open to the ambient. The lower end of the flue pipe 14 extends over a water heater flue 24. It is to be noted that the diameter of the flue pipe 14 is substantially greater than the diameter of the flue 24. The reason for this is that it is desired to enlarge the heat conducting area exposed to the flue gases and to slow down the passage of the flue gase through the flue pipe 14 in order to increase the time available to remove heat energy from the flue gases.

The bottom 18 is shown to be concave and is welded or otherwise secured in a water tight manner to the tank 12. The tank 18 need not be concave but may be straight or any other conventional configuration.

Extending through the wall of the tank 12 adjacent the bottom 18 is an inlet pipe 26. Also located adjacent the bottom 18 is a drain pipe 28 if it is desired for any reason to drain the water contained within the tank 12.

Located adjacent to bottom 18 but spaced therefrom is a baffle plate 30. The baffle plate 30 includes a pluarlity of holes or openings 32. The water from the inlet pipe 26, which is conducted from a supply, is conducted into the chamber 16 and passes through the openings 32 into the upper portion of the chamber 16. The function of the baffle 30 is to substantially eliminate the turbulence of the water contained within the tank 12. The reason for this is as the water is heated within the tank 16 it will assume different temperature layers and the water at the upper portion of the tank will be at a higher temperature than the water in the lower portion of the tank. By supplying cold supply water in the bottom of the tank as will become apparent further on in the specification the water is removed from the top of the tank which is the hottest water contained therein. In this way, the maximum efficiency of operation is achieved with the auxiliary tank 10 of this invention.

The outlet pipe 34 of the auxiliary heater tank 12 is conducted through the bottom 18 almost entirely through the longitudinal length of the tank 12 and is positioned adjacent the top 20. Surrounding almost the entire length of the outlet pipe 34 is an outer pipe 36. The inner wall of the outer pipe 36 is spaced from the outer wall of the outlet pipe 34 so as to form a space 38. The space 38 provides an insulative type of jacket for the heated water passing through the outlet pipe 34 so as to minimize dissipation of heat from the heated water 34 contained in the outlet pipe 34 as it passes through the lower end of the tank 12 which contains the cooler water. The outer pipe 36 is fixedly secured to the inner surface of the bottom 18.

Located within the tank 12 is an anode rod 40. The function of the anode rod 40 is to minimize the effect of electrolysis over a period of time within the tank 12. The use of such anode rods is well known and forms no specific part of this invention.

The outlet pipe 34 is connected through a union 42 to the inlet pipe 44 of a conventional water heater 46. A mounting rod 46 is fixed to the bottom 18 and is attached to a mounting plate 48. The mounting plate 48 includes a pair of openings 50 located adjacent either end of the plate 48. A bolt 52 is adapted to be extended through each opening 50. The bolts 52 are secured to an attaching plate 54. The attaching plate 54 is fixedly secured to a plug 56. The plug 56 is screw threadingly received within a tee 58. The tee 58 is also screw threadingly received to the outlet pipe 60 of the water heater 46. The tee 58 is also threadingly secured to a water pipe 62. The water pipe 62 is to supply heated water to within a place of residence.

Attached to the flue 24 is a condensate collector 64. The condensate collector 64 includes an annular chamber 66. A discharge conduit 68 is formed within the condensate collector 64. The discharge conduit 68 is adapted to be connected to an appropriate conduit or hosing to discharge collected condensate. The flue gas temperatures within the flue pipe 14 are, at times, reduced below dew point which creates condensation. The condensate collector 64 is used to gather the liquid and dispose of such exteriorly of the tank 12 through the discharge conduit 68. If the condensate collector 64 is not employed, the water would be conducted either upon the top of the water heater 46 or would be permitted to pass through the flue 24 to the bottom of the water heater 46 (adjacent the gas fired burner of the water heater 46). In either case, the accumulation of condensate in these areas is undesirable.

The flue pipe 14 extends within the annular chamber 66. The condensate forms as small droplets or beads of liquid on the inner surface of the flue pipe 14 and fall by gravity to within the annular chamber 66.

Extending through the flue pipe 14 are a plurality of heat conducting members 70. The heat conducting members 70 are normally metal rods but can comprise tubes or fins. The members 70 extend transversely through the flue pipe 14 and with the ends of such protruding into the chamber 16. It has been found that adequate protrusion outside of the flue pipe 14 of the member 70 is about one and a quarter inch at each end of each member 70. The members 70 are longitudinally spaced apart from each other and extend substantially from adjacent the baffle 30 to adjacent the top 20. It has also been found to be preferable to stagger the members 70 so that such are angularly disposed with respect to each other assuming somewhat of a spiral shaped pattern. The function of this is so as to cause turbulence as the flue gases move through the pipe 14 which efficiently removes as much heat as possible from the flue gases and effects a heating of the members 70 to the highest possible temperature. The number of the rods shown in the embodiment of this invention is thirty-four. However, it is considered to be within the scope of this invention that any convenient number of such members 70 could be employed. Each conducting member 70 forms a water tight connection with the flue pipe 14.

The operation of the auxiliary heater 10 of this invention is as follows. When the water heater 46 is operating, fuel gas is being burned causing the heating of the water contained within the water heater 46, the heated gases are then being conducted through the flue 24. In normal practice, it has been found that these gases within the upper end of the flue 24 will have a temperature of between 450° to 700°F. These gases are then caused to be conducted within the larger diametered flue pipe 14 and into contact with the heat conducting members 70. The heat energy from the flue gases cause the heating of the members 70, such heat energy being conducted through the heat conducting members 70 to within the confines of chamber 16 and actually absorbed or dissipated within the water contained within chamber 16. The gases are then conducted through the outlet flue pipe 22. The temperature of the gases passing through the outlet flue pipe 22 will normally be between 100° F and 220° F. Therefore, considering the temperature differential between the flue 24 and the outlet flue pipe 22, it can be seen that a substantial amount of heat energy has been absorbed by the heat conducting members 70 and by the wall of the flue pipe 14 and hence into the water contained within chamber 16.

The water contained within the chamber 16 is coldest adjacent the bottom 18 and becomes warmer until the water located at the top adjacent the top 20 is at the highest temperature. This heated water adjacent top 20 is conducted within the outlet pipe 34, down through the chamber 16 and into the water heater inlet pipe 44. The use of the outer pipe 36 and the space 38 between such and the pipe 34 minimize dissipation of the heat energy from the heated water to the colder water located in the bottom of the chamber 16. It has been found that in actual practice the temperature of the heated water within the auxiliary heater tank 12 will be between 90° F and 100° F.

To achieve maximum efficiency of this invention, it has been found to be preferable that the volume of the chamber 16 to be approximately forty to fifty percent of the volume of the water heater tank 46. This volume percentage eliminates the possibility of the auxiliary heating tank overheating and also maintains sufficient temperature differential between the flue gas and jacket water temperature to cause the auxiliary heating unit to function at a high degree of heat transfer efficiency.

This heated water that is conducted through the outlet pipe 34 and into the water heater 46 has been partially heated therefore requiring less heating by the fuel gas burner contained at the bottom of water heater 46. Therefore, less energy is used to achieve hot water at 140° F or 170° F being conducted into the water pipe 62.

The installation of the auxiliary heater 10 of this invention can be achieved quite simply by being placed upon a conventional water heater 46. One supporting point is obtained by the union 42 which interconnects the outlet pipe 34 and the inlet pipe 44. Two other supporting points are achieved through the bolts 52 and by adjusting of the nuts 72 located upon the bolts 52, variations in the annular position of the auxiliary heater 10 with respect to the water heater 46 can be achieved. Therefore, the auxiliary heater 10 of this invention can be installed in situations where by outlet flue 22 is not precisely aligned with the flue 24 and by varying the angular position of the auxiliary heater 10 with respect to the water heater 46, the necessary alignment is obtained with one end of the flue pipe 14 resting within the annular chamber 66 of the condensate collector 64 and the other end of the flue pipe 14 being secured to the outlet flue pipe 22.

It may be necessary to protect the interior wall of the flue pipe 14 against acid corrosion. It has been found that the condensate is at about 4 ph which is slightly acidic.

Figure 6:
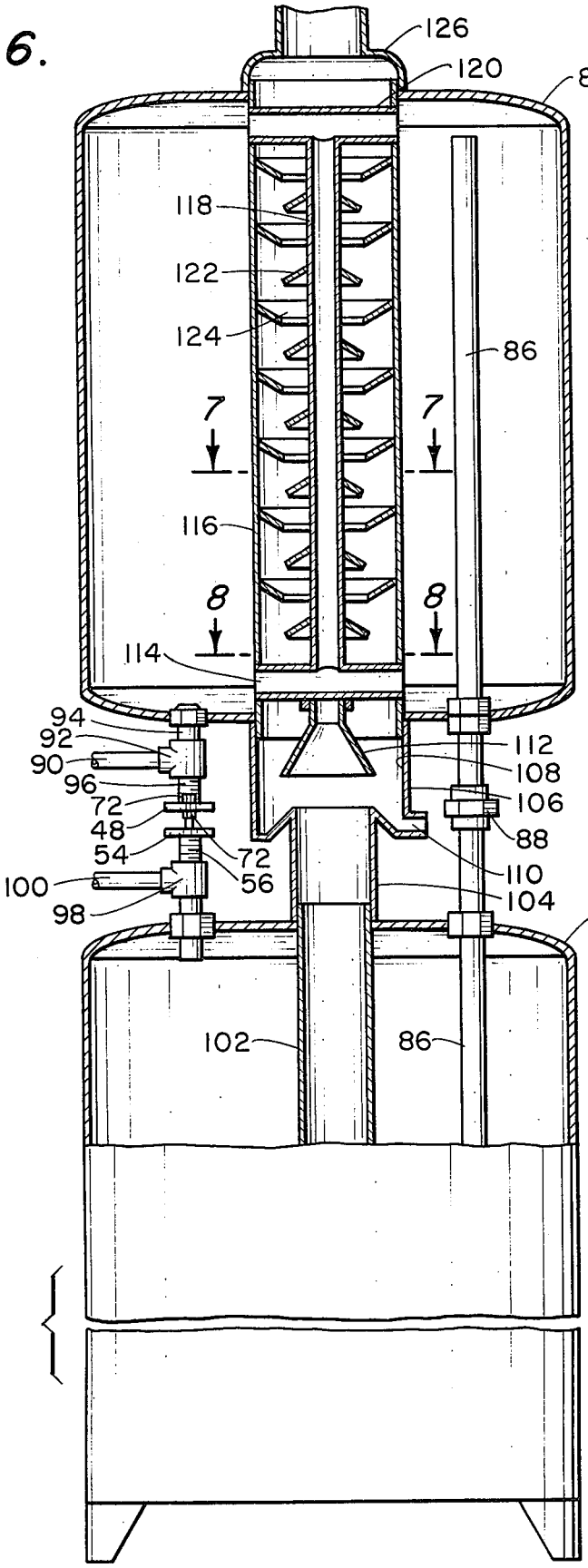
FIG. 6 is a view similar to FIG. 1 of a second embodiment of auxiliary heater tank of this invention.
Figure 7:
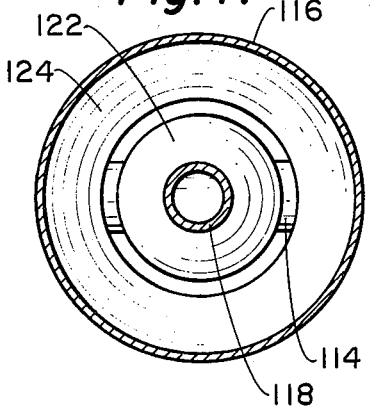
FIG. 7 is a cross-sectional view taken along line 7—7 of FIG. 6.
Figure 8:
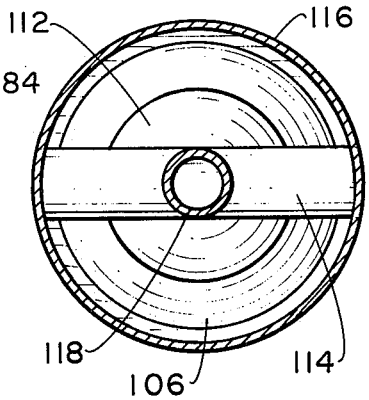
FIG. 8 is a cross-sectional view taken along line 8—8 of FIG. 6.

Referring in particularly to the second embodiment 80 of this invention as shown in particular in FIGS. 6, 7 and 8 of the drawings, there is shown an auxiliary preheater tank 82 which is mounted on top of a conventional water heater 84. An outlet water pipe 86 is located within the confines of the tank 82 and extends adjacent from the top thereof into the water heater tank 84 and terminates adjacent the bottom thereof. A union 88 interconnects the different sections of the pipe 86.

The water inlet to the tank 82 is provided through inlet pipe 90 which conducts water through a T-section of pipe 92. T-section 92 is threadably connected to conduit 94 which, in turn, is connected in a fluid tight manner to communicate with the chamber inside of tank 82.

The free end of the T-type connection 92 is threadably connected to a boss 96 which is connected to a mounting plate 48 of a leveling device which has been previously described. The mounting plate 48 is connected to an attaching plate 54 which is, in turn, connected to a plug 56 which, in turn, is threadably mounted within a T-type of connection 98. For a more detailed description of the leveling device, reference is to be had to the previous description wherein like numerals refer to like parts.

The water outlet from the water heater 84 is conducted through its appropriate water outlet tube through T-connection 98 and out through water outlet pipe 100.

The heated gases from the water heater 86 are conducted into the flue 102 and into extension pipe 104 of the condensate collector 106. The condensate collector is basically identical to condensate collector 64 and includes an annular chamber 108 therein and a discharge tube 110. The condensate collector 106 is fixedly secured to the lower surface of the tank 82.

Located within the confines of the annular chamber 108 is located a cone shaped deflector 112. The function of the deflector 112 is to keep the condensate from entering the flue pipe 102 and deflect such into the lower end of the annular chamber 108 to be conducted out through discharge tube 110.

The deflector cone 112 is fixedly secured to pipe 114. Pipe 114 extends across and is mounted within the lower end of flue pipe 116. Both ends of pipe 114 connect with the interior of the tank 82 and are adapted to permit the passage of water therein from the tank 82.

The pipe 114 connects with a vertical extension of pipe 118 which extends almost the entire length of the tank 82 and connects with a pipe 120 located ajacent the upper end of the tank 82. The pipe 120 is basically similar to pipe 114 and with both ends of pipe 120 connecting with the interior of the tank 82.

Mounted upon the pipe 118 in a spaced apart manner are a plurality of annular baffle members 122. Attached to the interior of the flue pipe 116 are a plurality of annular baffles 124. Each of the baffles 124 are substantially equidistantly spaced between a pair of baffles 122.

The flue gases from the interior of the flue 102 are conducted through the extension 104 and about the deflector cone 112, and upwardly about pipe 114 and pipe 118. The baffles 122 and 124 function to create a turbulant action of the gases tending to increase their velocity in order to extract as much heat from the gases as is possible. The heat is conducted within the metallic baffles 122 and 124 and also to within the metallic pipes 114, 118 and 120. The flue gases are then permitted to pass through the flue outlet pipe 126. The flue gasese are hottest at the pipe 114 and coolest at the pipe 120. However, the water contained within the pipe 114 will be cooler when the water contained within pipe 120 and in actual practice it is known that as the water moves through the pipe 118 there is a temperature gradient increase along its entire length from bottom to top. As a result, there is a thermal syphoning effect which, in essence, causes the water, due to the action of the heat energy, to be drawn into pipe 114, through pipe 118 and out through pipe 120 and back into the interior of the tank 82. This action increases the efficiency of the auxiliary preheater of this invention and therefore extracts as much of the heat energy as is possible.

Figure 9:
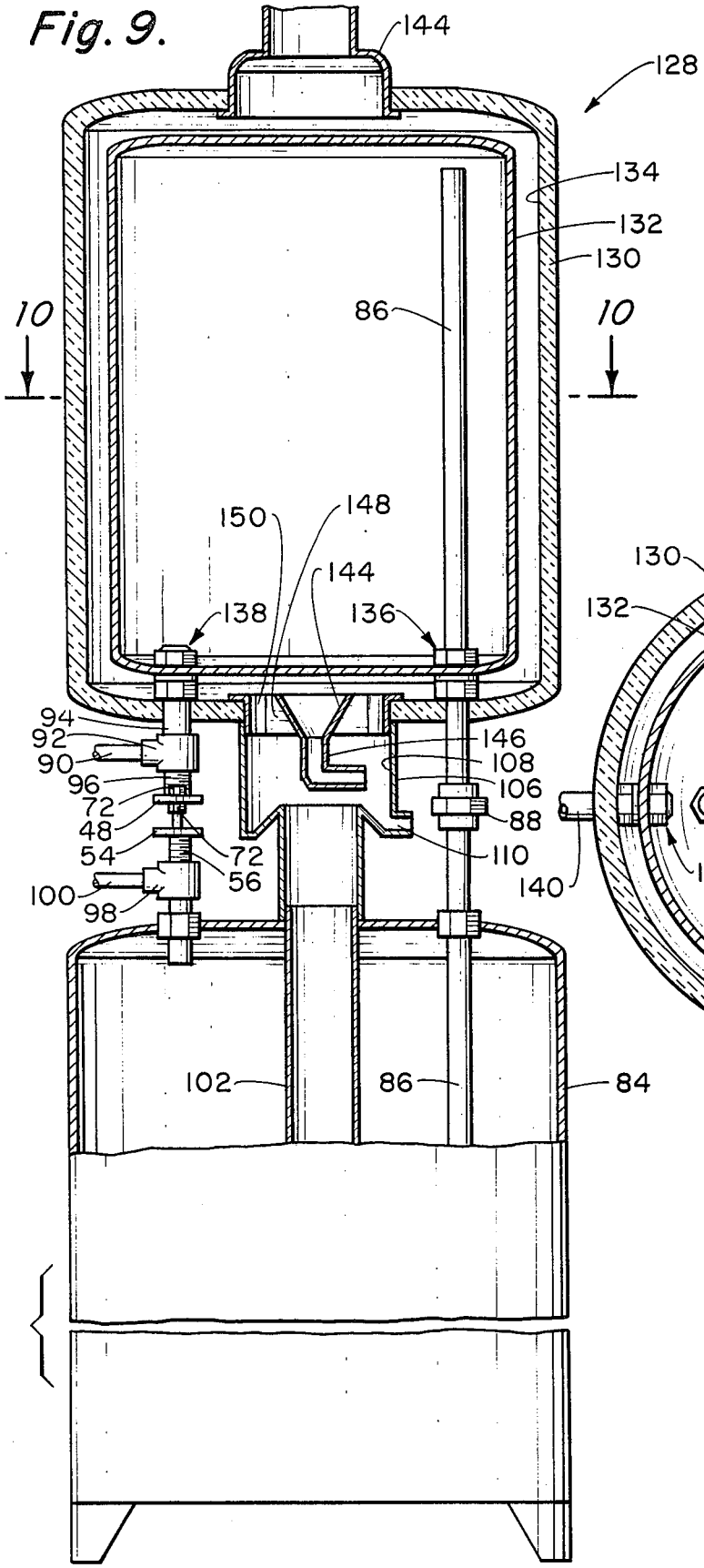
FIG. 9 is a view similar to FIG. 1 of a third embodiment of auxiliary heater tank of this invention.
Figure 10:
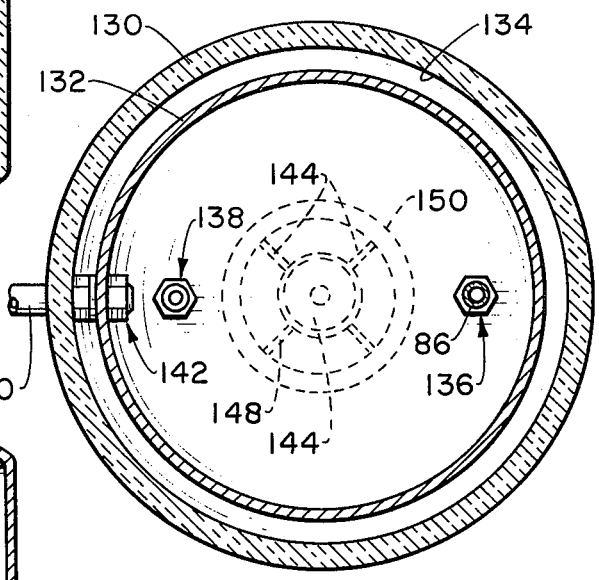
FIG. 10 is a cross-sectional view taken along line 10—10 of FIG. 9.

Referring particularly to FIGS. 9 and 10, a third embodiment 128 of auxiliary preheater of this invention is shown. The third embodiment 128 is mounted in a similar manner upon a water heater and actually like numerals have been employed to refer to like parts and reference is to be had to the previous description regarding like parts. It is to be noted within FIG. 9, that there is no leveling device shown as is shown in FIG. 6. However, it is considered to be within the scope of this invention to employ the leveling device which comprises generally the mounting plate 48 and attaching plate 54 which are interconnected by appropriate bolting arrangement. This structure would be included right with the T-type of connection 98 as is shown in FIG. 6.

The primary difference of the structure shown in FIGS. 9 and 10 is that the auxiliary preheater unit 128 of this invention does not include a centrally disposed flue pipe. The preheater unit 128 of this invention includes an outer tank wall 130 and an inner tank wall 132. The inner tank wall 132 is mounted in an inwardly spaced relationship with respect to outer tank wall 130. The actual configuration of the tank 130 and 132 could be either round or polygonal in shape, but in any event, there is a chamber 134 which is formed by the tank 132 being equally spaced from the inner wall of the tank wall 130.

The inlet pipe 86 includes an appropriate connector 136 which interconnects to both the inner tank 132 and the outer tank 130. In a similar manner, a connector assembly 138 is also interconnected between the tanks 132 and 130 and supporting pipe 94. The supporting pipe 94 is connected to the T-type connection 98.

The function of the connection assemblies 136 and 138 is to position and maintain the position of the tank 132 within the tank 130. The tank 132 is to be of a metallic material as also will normally be tank 130. Tank 130 may also include on the exterior thereof some form of insulation material. There also may be included other support means to maintain the position of the tank 132 with respect to 130.

The flue gases are to be conducted from the flue 102 through the chamber 108 of the condensate collector into chamber 134. In this manner, the flue gases completely surround the tank 132 and are absorbed through the wall of the tank 132 to hence be absorbed by the water located interiorly thereof. The flue gases are caused to be exited through the flue outlet pipe 144.

Any condensate that forms will form on the exterior of the tank 132 and will actually be caused to move centrally of the bottom of the tank 132 or will run down the interior of the tank 130. The condensate that runs down the interior of the tank 130 will actually just fall within the annular chamber 108 of the condensate collector 106 and out through the discharge tube 110. The condensate that collects on the tank 132 is caused to fall within funnel shaped cone 144 which, in turn, is passed through tube 146 to the lower end of the annular chamber 108 and through the discharge tube 110. The tube 144 is connected by appropriate supporting brackets 148 to a ring 150. The ring 150 is attached to the tank 130 and extends partially within the annular chamber 108 of the condensate collector 106.

What is claimed is:

1. In combination with a water heater tank having a heating means which produces heated gases which pass through a flue into the ambient, said water heater tank having a water inlet and a water outlet, an auxiliary heater comprising:

a tank having a top and a bottom and having an interior water chamber, said tank having a tank wall, said wall including opening means provided therein, said opening means connecting with said flue at said bottom and also connecting with an outlet flue pipe at said top, whereby the gases from said flue pass into said opening means at the bottom of said tank and then pass completely around said tank wall and hence into said outlet flue pipe at said top; and means for collecting condensate from said tank wall preventing such from entering said flue.

2. The combination as defined in claim 1 wherein:

said opening means comprises a space substantially encompassing said tank, whereby maximum wall area is provided in contact with the flue gases to obtain maximum heat transfer capability.

3. The combination as defined in claim 2 wherein:

said spacing being substantially of equal width completely about said tank.

4. The combination as defined in claim 2 wherein:

said means comprises a condensate collector located at the junction of said tank wall in said flue.

5. The combination as defined in claim 4 wherein:

said condensate collector includes an annular chamber which innerconnects said flue and said opening means, whereby the flue gases are required to pass through said annular chamber prior to entering said opening means, a condensate discharge tube centrally located within said annular chamber, whereby the condensate dripping from tank wall will pass into said discharge tube and hence exteriorly of said annular chamber.

6. The combination as defined in claim 5 wherein:

said discharge tube includes a funnel shaped cone, the largest diameter of said funnel shaped cone is at least equal to the diameter of said flue, whereby condensate dripping into said discharge tube will be prevented from being conducted into said flue.

7. The combination as defined in claim 6 wherein:

the wall of said condensate collector including an annular collecting chamber, said annular collecting chamber located exteriorly of and slightly below the upper open end of said flue, the wall of said condensate collector in the area of said discharge chamber including a discharge opening which is adapted to carry collected condensate to an exterior condensate disposing location.

8. The combination as defined in claim 7 wherein:

said tank being within the range of thirty to forty percent by volume of said water heater tank.

* * * * *